United States Patent [19]

Keska

[11] Patent Number: 4,953,785

[45] Date of Patent: Sep. 4, 1990

[54] TRACK ASSEMBLY FOR TOY VEHICLE

[75] Inventor: Tadeusz Keska, Smithfield, R.I.

[73] Assignee: Hasbro, Inc., Pawtucket, R.I.

[21] Appl. No.: 237,843

[22] Filed: Aug. 29, 1988

[51] Int. Cl.[5] ..... E01B 23/00; A63H 19/30

[52] U.S. Cl. ..... 238/10 A; 238/10 E

[58] Field of Search ..... 238/10 R, 10 A, 10 E, 238/10 F; 104/DIG. 1; 446/444, 96

[56] References Cited

U.S. PATENT DOCUMENTS

| | | | |
|---|---|---|---|
| 4,084,746 | 4/1978 | Cheng | 238/10 F |
| 4,091,995 | 5/1978 | Barlow et al. | 238/10 A |
| 4,106,695 | 8/1978 | Carella et al. | 238/10 F |
| 4,179,066 | 12/1979 | Teter | 238/10 E |
| 4,219,153 | 8/1980 | Cheng | 104/DIG. 1 X |

FOREIGN PATENT DOCUMENTS

| | | | |
|---|---|---|---|
| 0014162 | 8/1980 | European Pat. Off. | 238/10 F |
| 2099317 | 12/1982 | United Kingdom | 238/10 F |
| 0718825 | 11/1984 | United Kingdom | 238/10 R |

*Primary Examiner*—Robert J. Oberleitner

*Attorney, Agent, or Firm*—Salter & Michaelson

[57] ABSTRACT

A track assembly for toy vehicles includes a first track section having an elongated fastening tongue element on one end thereof and a second track section having a receiving slot on one end thereof. The fastening tongue element is receivable in the receiving slot to connect the track sections together in substantially aligned end-to-end relation and it includes an elongated resilient finger which is engageable with a detent in the receiving slot to releasably retain the fastening tongue element in the receiving slot.

11 Claims, 2 Drawing Sheets

TRACK ASSEMBLY FOR TOY VEHICLE

BACKGROUND AND SUMMARY OF THE INVENTION

The instant invention relates to toys and more particularly to a track assembly for toy vehicles, such as toy trains and the like.

Toy vehicles which travel along preestablished paths on track assemblies have generally been found to be highly popular with persons of various ages. For example, model trains which travel on track sections which resemble railroad tracks have been found to be highly popular for many years with both children and adults. In this connection, the track assemblies which have been heretofore available for use in connection with toy vehicles have generally comprised of a plurality track sections which are receivable in interfitting relation in order to form a predetermined track for a toy vehicle, such as a toy train. However, the mechanisms which have been incorporated in the heretofore available track assemblies of this general type for connecting the track sections thereof together have generally been found to be either overly complicated or less then entirely effective for securely fastening the track sections thereof together in a manner which nevertheless permits them to be easily disconnected. In this regard, the track assemblies disclosed in the TETER U.S. Pat. No. 4,179,006; LEE U.S. Pat. No. 4,372,489; SCHWAGER U.S. Pat. No. 4,496,100; NEUHIERL U.S. Pat. No. 4,540,119; SCHOLEY U.S. Pat. No. 4,544,094 represent the closest prior art to the subject invention of which the applicant is aware. However, the track assemblies disclosed in these references generally include relatively complex mechanisms for connecting the track sections thereof together and in many cases the track sections of these track assemblies require relatively difficult and awkward manipulations in order to disconnect the track sections thereof.

The instant invention provides an effective track assembly for toy vehicles comprising a plurality of track sections which are readily and easily connectable so that they are maintained in substantially aligned end-to-end relation but so that they are nevertheless easily disconnectable when desired. Specifically, the track assembly of the instant invention comprises a first track section having a first end and including a first track element, a second track section having a second end and including a second track element, a fastening tongue element on the first end of the first track section and means defining a receiving slot on the second end of the second track section. The fastening tongue element and the means defining a receiving slot are constructed so that the fastening tongue element is releasably resiliently snap receivable an engagement in the receiving slot for releasably connecting the first and second track sections together in an assembled position wherein they are in substantially aligned end-to-end relation and wherein the track elements thereon cooperate to define a substantially continuous track for a toy a vehicle. The fastening tongue element is preferably of elongated configuration and it extends outwardly from the first end of the first track section and it is preferably constructed so that it is resiliently compressible to enable the fastening tongue element to be resiliently snap received in engagement in the receiving slot. More specifically, the fastening tongue element preferably includes an elongated main portion and an elongated resiliently deflectable finger which extends along one side of the main portion and is resiliently deflectable to enable the fastening tongue element to be snap received in engagement in the receiving slot. The finger is preferably constructed so that it defines a resiliently depressible bump on one side of the fastening tongue element and the means defining a slot on the second track section preferably includes an inwardly projecting detent which is engageable with a bump on the finger to deflect the finger toward the main portion and to then release the finger as the fastening tongue element is inserted into the receiving slot. The track assembly is preferably constructed so that the first track section includes means defining a second receiving slot on the first end thereof and so that the second track section includes a second fastening tongue element on the second end thereof, the second fastening tongue element being receivable in the second slot for further releasably connecting the first and second track sections together in substantially aligned end-to-end relation. The track assembly is preferably further constructed so that one of the track sections thereof includes an elongated alignment tongue and so that the other track section includes an alignment slot which is dimensioned for receiving the alignment tongue in order to further position and maintain the first and second track sections in substantially aligned relation.

It has been found that the track assembly of the instant invention can be effectively utilized in connection with various toy vehicles, such as toy trains or cars. Specifically, it has been found that the first and second track sections are readily and easily securable in substantially aligned relation by merely inserting the fastening tongue elements of the track sections into the adjacent receiving slots so that the resilient fingers of the fastening tongue elements pass by the detents in the receiving slots to releasably secure the track sections together. When the track sections are assembled in this manner, the track elements thereon form a substantially continuous track for guiding the movement of a toy vehicle on the track assembly. However, because of the manner in which the fastening tongue elements are receivable in the receiving slots, the track sections can be easily disconnected when desired simply by pulling them apart. Still further, because of the overall construction of the track assembly, the track sections, including the fastenting tongue elements and the receiving slots, can be integrally molded from a suitable plastic material in order to adapt the track assembly for relatively inexpensive constructions.

Accordingly it is a primary object of the instant invention to provide an effective track assembly for toy vehicles.

Another object of the instant invention is to provide an effective track assembly for toy vehicles comprising a pair of track sections which are easily detachably connectable so that they are maintained in substantially aligned relation.

Another object of the instant invention is to provide an effective track assembly for toy vehicles comprising a plurality of track sections having fastening tongues and receiving slots thereon, wherein the fastening tongues and the receiving slots can be integrally molded with their respective track sections from a suitable plastic material.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
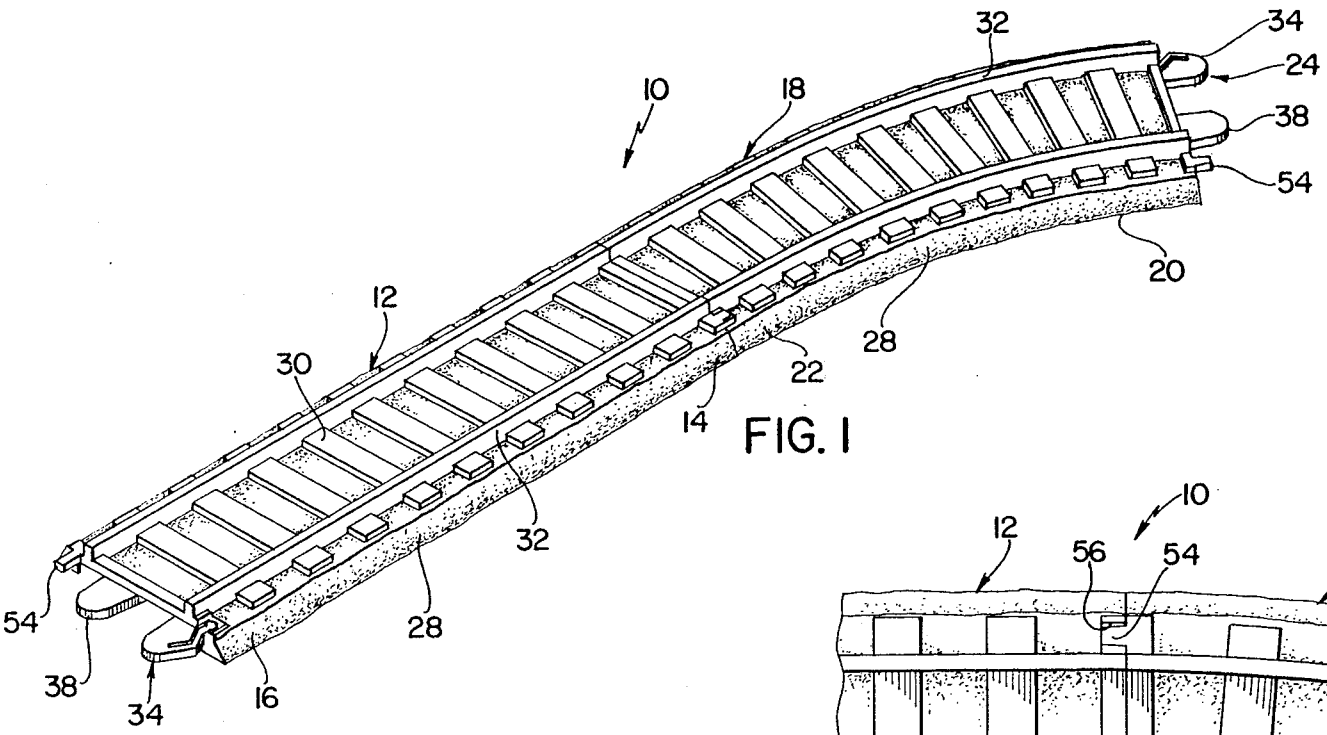
FIG. 1 is a perspective view of the track assembly of the instant invention.
Figure 2:
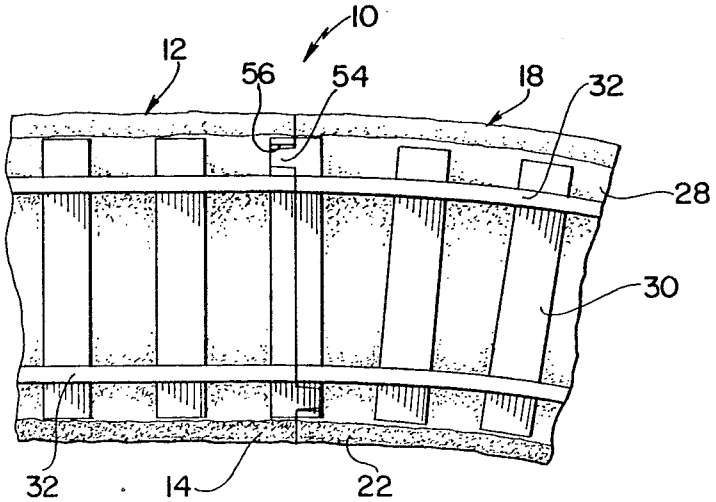
FIG. 2 is an enlarged fragmentary top plan view thereof.

Referring now to the drawings, the track assembly of the instant invention is illustrated and generally indicated at 10 in FIGS. 1–5. The track assembly 10 comprises a first track section generally indicated at 12 having a first end 14 and a second end 16, and a second track section generally indicated at 18 having a first end 20 and a second end 22. A first coupling assembly generally indicated at 24 is formed on each of the first ends 14 and 20 of the track sections 12 and 18, respectively and a second coupling assembly generally indicated at 26 is formed on each of the second ends 16 and 22, of the track sections 12 and 18, respectively. The coupling assemblies 24 and 26 are of generally complementary configuration and they are adapted for effectively and easily detachably connecting the track sections 12 and 18 together in substantially aligned relation as illustrated.

The first and second track sections 12 and 18 are preferably integrally molded from a suitable plastic material and each includes a track bed portion 28 which is adapted to simulate the bed of a railroad track, a plurality of ties 30 on track bed 28 thereof and a pair of spaced elongated track elements 32 on the ties 30 thereof. The track beds 28, the ties 30 and the track elements 32 are adapted and positioned so that when the track sections 12 and 18 are disposed in spaced, substantially aligned relation the track elements 32 cooperate to define a pair of substantially continuous tracks for guiding the movement of a toy vehicle, such as a toy train on the track assembly 10.

Each of the first coupling assemblies 24 comprises an elongated fastening tongue element generally indicated at 34, a receiving slot 36, an alignment tongue 38 and an alignment slot 40. Each of the fastening tongue elements 34 includes an elongated longitudinal extending main portion 42 which extends outwardly terminating in a rounded outer end and an elongated longitudinally extending resilient finger 44 which is integrally joined to the main portion 42 at a point which is spaced inwardly slightly from the terminal end thereof. The finger 44 extends inwardly in closed spaced relation along one side of the main portion 42 thereof terminating in a free end. As a result, each of the tongue elements 34 is, in effect, resiliently transversely compressible by deflecting the finger 44 thereof toward the main portion 42 thereof. Each of the fingers 44 terminates in a terminal end 46 and each is formed so that it includes a bump 48 which is inwardly depressible as a result of the resiliently deflectable construction of the fingers 44. The perimeter of each of the main portions 42 is defined by a fence or wall 50 which also defines the perimeters of the respective alignment slot 40, the alignment finger 38 and the receiving slot 36 thereof. Each of the receiving slots 36 is of generally U-shaped configuration and each opens outwardly so that a fastening tongue element 34 of another track section can be received therein as will hereinafter be more fully set forth. Each of the receiving slots 36 includes an inwardly projecting detent element 52 which is formed so that it is engageable with the bump 48 on a finger 44 of another track section as will also hereinafter be more fully set forth. Also included in each of the first coupling assemblies 24 is a tooth 54 on the first end 14 adjacent the receiving slot 36 thereof and a notch 56 is formed in the first end 14, the notch 56 being adapted for receiving a tooth 54 of another track section as will also hereinafter be more fully set forth.

The second coupling assemblies 26 are preferably identical to the first coupling assemblies 24 and hence, they each include a fastening tongue element 34 having a resilient finger 44, a receiving slot 36, an alignment tongue 38 and an alignment slot 40. Each of the second coupling assemblies 26 also includes a tooth 54 and a notch 56.

Figure 3:
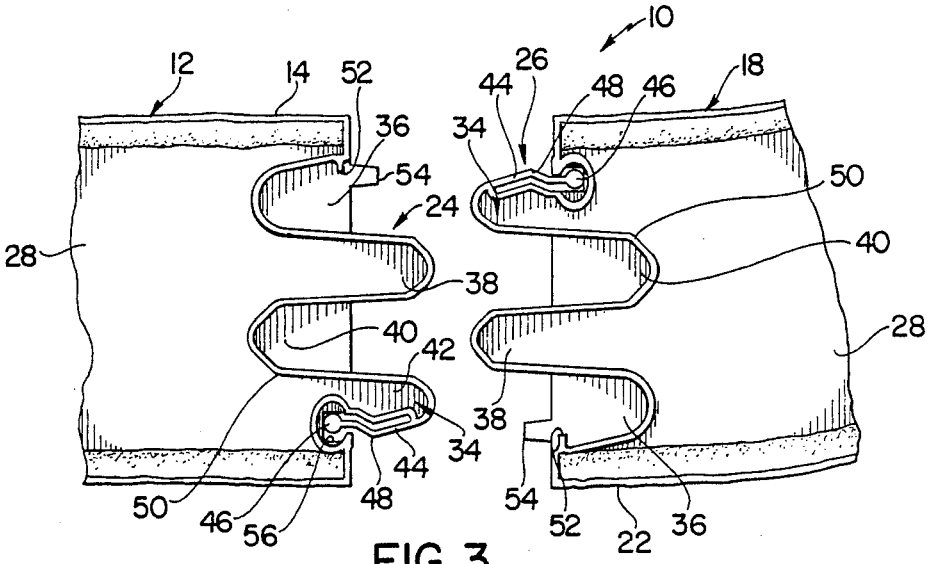
FIGS. 3–5 are sequential fragmentary bottom plan views illustrating the interaction between the fastening tongue elements and the receiving slots.
Figure 4:
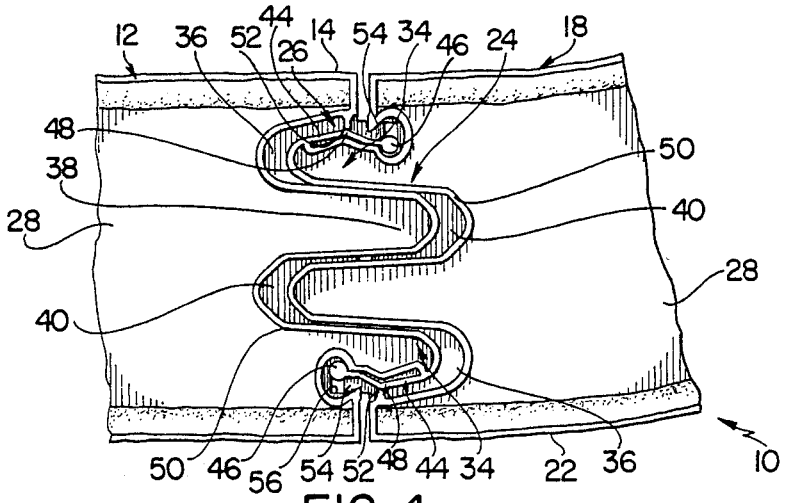
Figure 5:
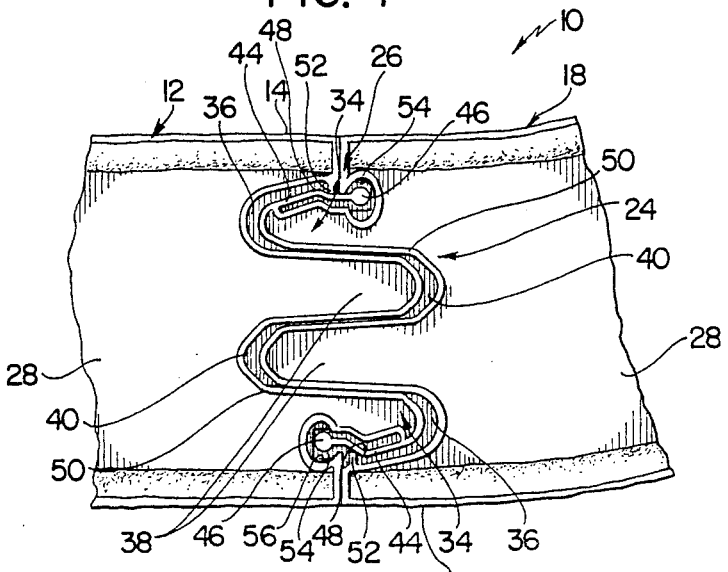

The first and second coupling assemblies 24 and 26 are adapted to be received in engagement in the assembled position illustrated in the FIGS. 3–5 wherein the fastening tongue elements 34 are received in the receiving slots 36 and the alignment tongues 38 are received in the alignment slots 40. In this regard, as the fastening tongue elements 34 are advanced into the receiving slots 36, the bumps 48 cam on the detent elements 52 to move the fingers inwardly towards the main portions 42 as illustrated in FIG. 4. However, once the detent elements 52 have passed over the bumps 48, the fingers 44 are resiliently returned to their original positions in order to lock the fastening tongue elements 34 in the slots 36 in the manner illustrated in FIG. 5. Further, as the fastening tongue elements 34 are advanced into the receiving slots 36 in this manner, the alignment tongues 38 are received in the alignment slots 40 to further retain the track sections 12 and 18 in substantially aligned relation and finally the teeth 54 are advanced into the notches 56 to further prevent lateral movement between the first and second track sections 12 and 18. Thereafter, the fingers 34 and the detent elements 52 cooperate to maintain the track sections 12 and 18 in aligned engagement, although the track sections 12 and 18 can nevertheless be disengaged by pulling them apart so that the detent elements 52 again move the fingers 44 inwardly as they pass over the bumps 48.

It is seen therefore that the instant invention provides an effective track assembly for toy vehicles, such as toy trains and the like. The coupling assemblies 24 and 26 are operative for effectively securing the track sections 12 and 18 together in a manner which nevertheless permits them to be easily disconnected when desired. Further, since the coupling assemblies 24 and 26 are of substantially identical configuration the track sections 12 and 18 can be alternatively assembled so that two of the first coupling assemblies 24 or two of the second coupling assemblies 26 are received in engagement. Hence, for these reasons as well as the other reasons hereinabove set forth it is seen that the track assembly of the instant invention represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A track assembly for a toy vehicle comprising a first track section having a first end and a second track section having a second end, each of said track sections including at least one longitudinally extending track element for guiding said vehicle in its movement thereon, said first track section including an integrally molded fastening tongue element on he first end thereof, said second track section including means defining a receiving slot on the second end thereof, said fastening tongue element being of elongated configuration and including an elongated longitudinally extending main portion which extends outwardly terminating in an outer end and an elongated longitudinally extending resilient finger which is integrally joined to said main portion adjacent said outer end and extends inwardly along one side of said main portion, said finger being resiliently deflectable to enable said fastening tongue element to be releasably resiliently snap received in engagement in said receiving slot for releasably connecting said first and second track sections together so that they are maintained in substantially aligned end-to-end relation.

2. In the track assembly of claim 1, said fastening tongue element being of elongated configuration and being resiliently transversely compressible to enable it to be resiliently snap received in engagement in said receiving slot.

3. In the track assembly of claim 1, said fastening tongue element being of elongated configuration and including a resiliently depressible bump on one side thereof, said means defining said slot including inwardly projecting detent means, said detent means being engageable with said bump for depressing the latter as said fastening tongue element is inserted into said slot.

4. In the track assembly of claim 1, said fastening tongue element and said slot being of elongated configuration, at least one of either said fastening tongue element or said slot including an elongated longitudinally extending finger on one side thereof, said finger being resiliently deflectable to enable said fastening tongue element to be releasably resiliently snap received in said receiving slot.

5. In the track assembly of claim 4, said finger defining a resiliently depressible bump on one side of said fastening tongue element, said means defining said slot including inwardly projecting detent means, said detent means being engageable with said bump for sequentially depressing and then releasing said bump as said fastening tongue element is inserted into said receiving slot in order to releasably retain said fastening tongue element in said slot.

6. In the assembly of claim 1, said fastening tongue element further characterized as a first fastening tongue element, said slot further characterized as a first slot, said second track section further comprising a second fastening tongue element on the second end thereof, said first track section further comprising means defining a second slot on the first end thereof, said second fastening tongue element being releasably resiliently snap receivable in engagement in said second slot for further releasably connecting said first and second track sections together so that they are maintained in substantially aligned end-to-end relation.

7. The assembly of claim 1 further comprising an elongated alignment tongue on either the first end of said first track section or the second end of said second track section and means defining an alignment slot on the other one of either the first end of said first track section or the second end of said second track section, said alignment tongue being releasably receivable in said alignment slot for further positioning and maintaining said first and second track sections in substantially aligned relation.

8. In the track section of claim 1, said main portion outer end being of rounded configuration.

9. In the track section of claim 8, said resilient finger being integrally joined to said main portion at a point which is spaced inwardly from said outer end.

10. In the track section of claim 1, said resilient finger being integrally joined to said main portion at a point which is spaced inwardly from said outer end.

11. In the track section of claim 1, said resilient finger terminating in a free terminal end.

* * * * *